US005297932A

United States Patent [19]

Johnson

[11] Patent Number: 5,297,932

[45] Date of Patent: * Mar. 29, 1994

[54] FASTENER FOR MULTI-STAGE COMPRESSOR

[75] Inventor: Thomas G. Johnson, Palm Beach Gardens, Fla.

[73] Assignee: United Technologies Corporation, Hartford, Conn.

[ * ] Notice: The portion of the term of this patent subsequent to Jul. 21, 2009 has been disclaimed.

[21] Appl. No.: 581,223

[22] Filed: Sep. 12, 1990

[51] Int. Cl.[5] ..... F04D 29/60

[52] U.S. Cl. ..... 415/209.2; 415/134

[58] Field of Search ..... 415/134, 135, 136, 139, 415/173.2, 209.2, 189, 190, 108

[56] References Cited

U.S. PATENT DOCUMENTS

| | | | |
|---|---|---|---|
| 2,497,049 | 2/1950 | Soderberg | 415/134 |
| 2,843,357 | 7/1958 | Spindler, Jr. | 415/189 |
| 2,863,634 | 12/1958 | Chamberlin et al. | 415/134 |
| 3,362,160 | 1/1968 | Bourgeois | 415/201 |
| 4,330,234 | 5/1982 | Colley | 415/173.2 |
| 4,529,355 | 7/1985 | Wilkinson | 415/173.2 |

FOREIGN PATENT DOCUMENTS

| | | | |
|---|---|---|---|
| 606401 | 10/1960 | Canada | 415/134 |
| 1296877 | 6/1969 | Fed. Rep. of Germany | 415/190 |
| 2019954 | 11/1979 | United Kingdom | 415/190 |

*Primary Examiner*—John T. Kwon
*Attorney, Agent, or Firm*—Norman Friedland

[57] ABSTRACT

The stator case for the compressor of a gas turbine engine is tied to the outer full hoop case by a spool/bolt assembly where the spool carries flange-like elements bearing against both cases and always being in compression and the bolt includes a relatively long shaft extending through the outer case to tie it to the spool which is threaded to bosses formed on the stator case for providing sufficient support during an engine surge while having good fatigue life characteristics. The threads of the bolt and spool are sized differently to assure that the bolt loosens before the spool.

6 Claims, 2 Drawing Sheets

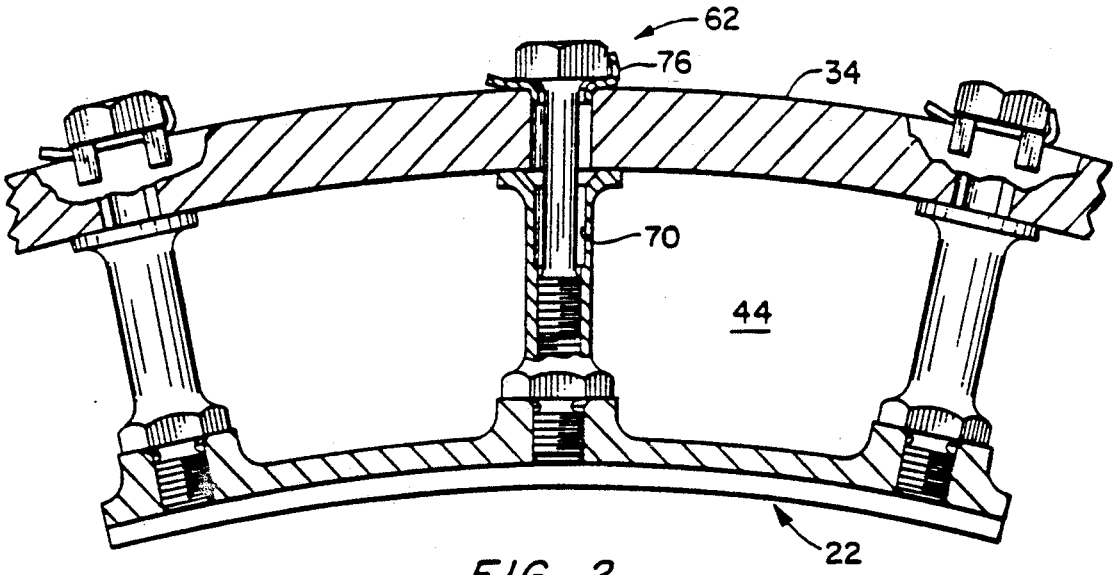
FIG. 2
FIG. 3
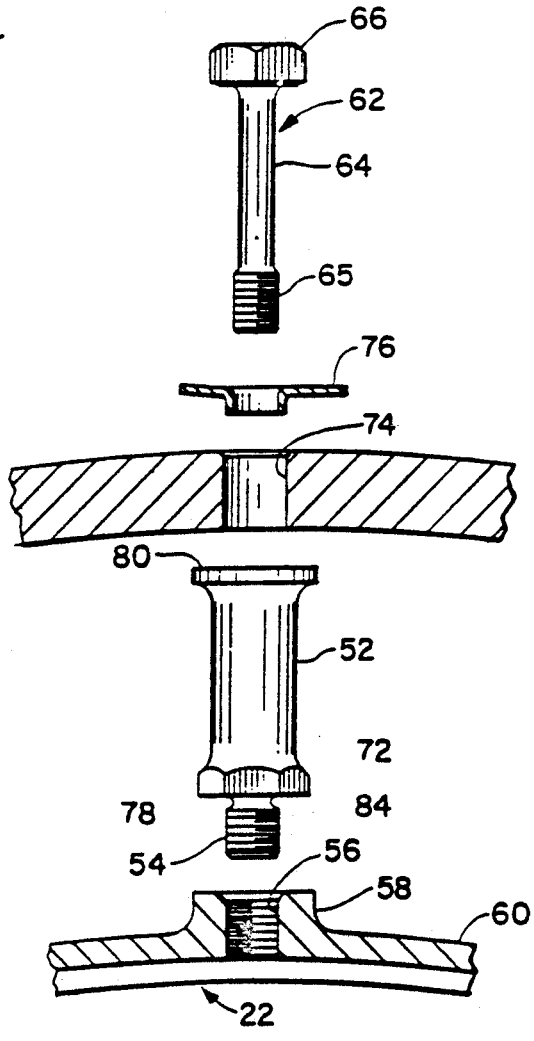

FASTENER FOR MULTI-STAGE COMPRESSOR

CROSS REFERENCE

The subject matter of this application is related to the subject matter of the following commonly assigned patent applications: U.S. application Ser. No. 07/581,224 entitled "Fastener Mounting For Multi-Stage Compressor"; U.S. application Ser. No. 07/581,231 entitled "Case Typing Means For A Gas Turbine Engine"; U.S. application Ser. No. 07/581,230 entitled "Compressor Bleed"; U.S. application Ser. No. 07/581,229 entitled "Segmented Stator Vane Seal"; U.S. application Ser. No. 07/581,228 entitled "Backbone Support Structure For Compressor"; U.S. application Ser. No. 07/581,227 entitled "Compressor Case Construction With Backbone";U.S. application Ser. No. 07/581,219 entitled "Compressor Case Construction"; U.S. application Ser. No. 07/581,240 entitled "Compressor Case Attachment Means"; U.S. application Ser. No. 07/581,220 entitled "Compressor Case With Controlled Thermal Environment"; all of the above filed on even date herewith.

TECHNICAL FIELD

This invention relates to gas turbine engines and more particularly to the construction of the compressor section.

BACKGROUND ART

As is well known, the compressor case of a gas turbine engine powering aircraft is subjected to severe pressure and temperature loadings throughout the engine operating envelope and care must be taken to assure that the components remain concentric maintaining relatively close running clearances so as to avoid inadvertent rubs. Inasmuch as the engine case is thin relative to the rotor and stator components in the compressor section, it responds more rapidly to temperature changes than do other components. This is particularly true during periods of transient engine performance. Typical of these transients are throttle chops, throttle bursts, and the like. Obviously it is customary to provide sufficient clearances during these transients to assure that the rotating parts do not interfere with the stationary parts.

The problem becomes even more aggravated when the engine case is fabricated in two halves (split case) which is necessitated for certain maintenance and construction reasons. Typically, the halves are joined at flanges by a series of bolts and the flanges compared to the remaining portion of the circumference of the case is relatively thick and hence does not respond to thermal and pressure changes as quickly as the thinner portion of the case. The consequence of this type of construction is that the case has a tendency to grow eccentrically or out of round.

In certain instances in order to attain adequate roundness and concentricity to achieve desired clearance between the rotating and nonrotating parts, it was necessary to utilize a full hoop case for the highest stages of a multiple stage compressor. Since the stator components, i.e., stator vanes and outer air seals, are segmented the problem was to assure that the compressor maintained its surge margin notwithstanding the fact that the outer case would undergo large deflection at acceleration and deceleration modes of operation. The cavity that exists between the outer case and the inner case formed by the segmented stator components, being subjected to pressures occasioned by the flow of engine air through the various leakage paths, presented a unique problem. In the event of a surge, which is a non-designed condition, the pressure in the gas path would be reduced significantly. Because the air in the cavity is captured and cannot be immediately relieved, it would create an enormous pressure difference across the stator components, cause them to distort, with a consequential rubbing of the compressor blades, and a possible breakage.

In order to withstand this pressure loading and yet achieve the roundness and clearance control of the stationary and rotating components it was necessary to incorporate a mechanism that would tie the outer case to the segmented stator components. While it became important to assure that this rubbing did not occur, particularly where severe rubbing could permanently damage the blades and/or rotor/stator during surge, the mechanism that is utilized must be capable of withstanding this enormous load, yet be insensitive to fatigue. The most obvious solution to solving the load problem is to utilize sufficiently large bolts that could carry the load. The problem with this solution is that fatigue life is inversely proportional to the size of the bolt. The larger the diameter of the bolt the more sensitive it is to fatigue. The problem is more aggravated since the engine is designed to avoid surge and surge may be non-existing so the part used to solve the problem only has utility during a circumstance that may not occur. Thus, it is abundantly important that it doesn't present a maintenance problem, i.e. require early removal because of fatigue. Furthermore, it shouldn't be unduly heavy, since weight would impact overall engine performance.

I have found that I can obviate these problems by fabricating the fastener into two major component parts; 1) an outer spool threadably engaging the inner segmented stator vane/outer air seal assembly (case) and 2) a bolt threadably engaging an internal thread formed on the inner diameter of the outer spool that is supported to the outer full hoop case. The threads on the spool are dimensioned differently than the threads on the bolt so that the breakaway torque on the bolt is such that it will loosen before the spool loosens. The head of the bolt is dimensioned relative to the shank of the bolt such that it enhances fatigue life. By incorporating the spool into the fastener the design permitted the use of a bolt that had a longer shank than the heretofore known short shank designs, which improved the fatigue loading. It is contemplated that the end of the spool carries a washer like face that bears against the surface of the outer case so that the threads of the spool mating the threads of the inner case is insensitive to fatigue loading inasmuch as the spool is preloaded by this washerlike face. The spool is mounted so that it is always in compression which has the advantage of reducing fatigue of the bolt and stresses that occur as a result of a surge condition.

BRIEF DESCRIPTION OF THE DRAWING

FIG. 2 is a partial sectional view partly in schematic taken along lines 2—2 of FIG. 1 showing one of several segments of the components making up the inner case.

FIG. 3 is an exploded view showing the details of this invention.

STATEMENT OF THE INVENTION

Figure 1:
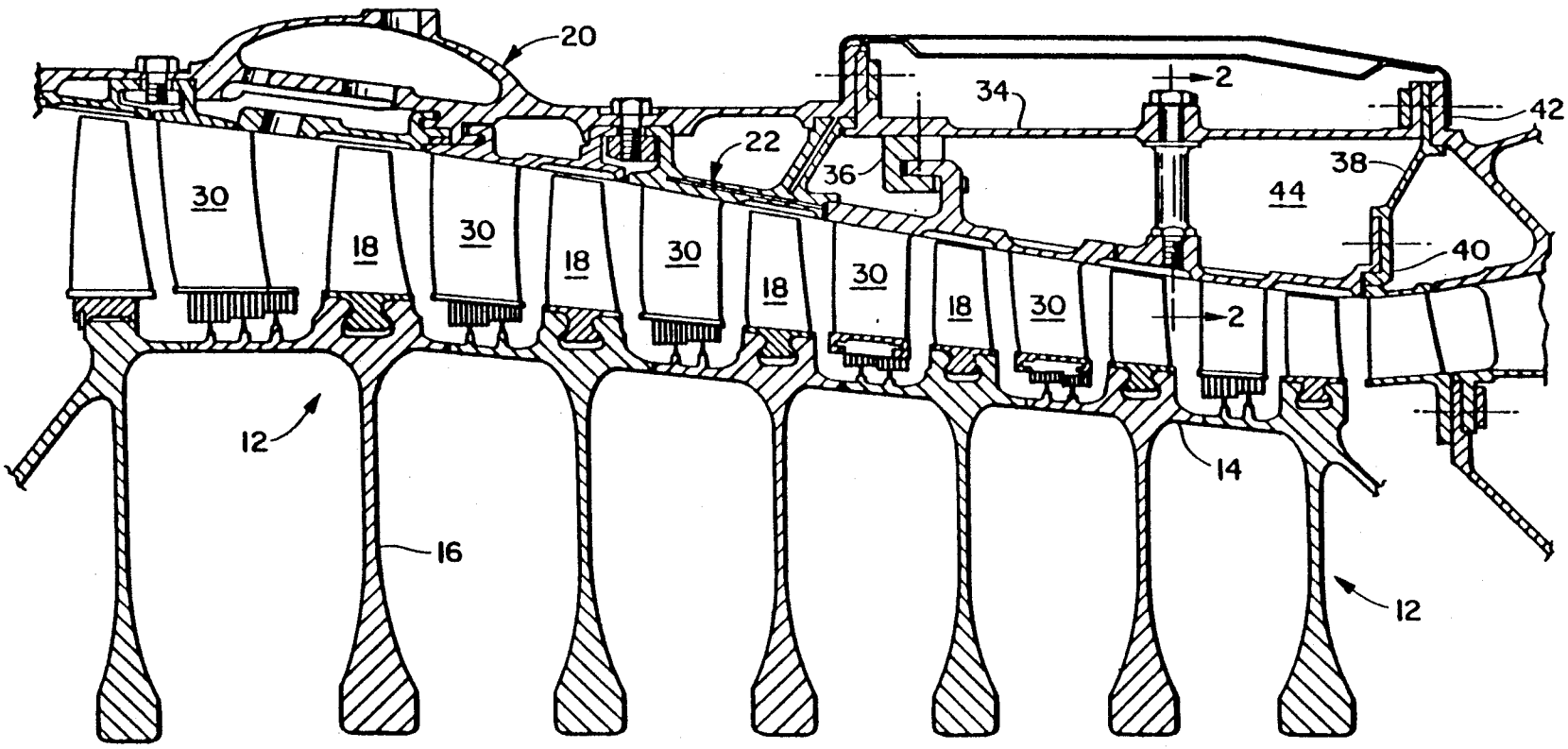
FIG. 1 is a partial view partly in section and partly in elevation of a multi-stage axial flow compressor for a gas turbine engine.

An object of this invention is to provide improved fastener means for tying the inner case of the compressor of a gas turbine engine to the outer case so as to withstand stresses occasioned by compressor surge and to reduce fatigue on the fastener.

A further object of this invention is to utilize a fastener that incorporates a spool having end flanges bearing against the inner and outer cases whereby the spool serves as a compressor flange-like element to reduce both fatigue and surge stresses. The spool allows the use of a longer shank on the bolt than could otherwise be used.

A feature of this invention is to provide a fastener having a spool element and a bolt element threadably engaging the spool such that the threads on the spool mating the threads on the item securing the spool is at a different diameter than the threads on the bolt to assure that one set of threads disengages before the other set of threads during disassembly.

A still further feature of this invention is that the head of the bolt on a spool/bolt fastener apparatus is sufficiently large relative to the shank of the bolt so as to increase fatigue life of the fastener.

A further feature of this invention is to thread the spool into a boss formed on the inner case and preload the threads of the spool by an adjacent washer face integral to the spool so that the threads are insensitive to fatigue loading.

The foregoing and other features and advantages of the present invention will become more apparent from the following description and accompanying drawings.

BEST MODE FOR CARRYING OUT THE INVENTION

To best understand this invention reference is made to FIGS. 1, 2 and 3 showing part of a multi-stage compressor for a gas turbine engine of the type for powering aircraft. For more details of a gas turbine engine the F100 family of engines manufactured by Pratt & Whitney, a division of United Technologies Corporation, the assignee of this patent application, is incorporated herein by reference. Suffice it to say that in the preferred embodiment the engine on which this invention is being utilized is a fan-jet axial flow compressor multi-spool type. As noted in FIG. 1 the compressor section generally indicated by reference numeral 10 is comprised of a plurality of compressor rotors 12 retained in drum rotor 14, where each rotor includes a disk 16 supporting a plurality of circumferentially spaced compressor blades 18. The rotors 12 are suitably supported in an outer engine case 20 and an inner case 22.

In this configuration a portion of the outer case 20 is fabricated in two axial circumferential halves and the other portion is fabricated in a full hoop generally cylindrically shaped case. In FIG. 1 the first four lower pressure stages as viewed from the left hand side are housed in the split case and the last three stages are housed in the full case.

Inasmuch as this invention pertains to the aft section (full case) of the compressor, for the sake of simplicity and convenience only the portion of the compressor dealing with the full case will be discussed hereinbelow. The inner case 22 which comprises the stator vanes 30 and outer air seal 32 are supported in the full case 34 via the dog-jaw hook connection 36 and the bulkhead 38 which carries suitable attaching flanges 40 and 42.

As was mentioned above the problem associated with this construction is that the cavity 44 between the inner case 22 and outer case 34 is ultimately pressurized by the fluid leaking therein from the engine flow path. The engine flow path is defined by the annular passageway bounded by the inner surface of the inner case 22 and outer surface of drum rotor 14. This pressure can reach levels of 5-600 pounds per square inch (PSI). Should a surge situation occur the pressure level in the gas path can reduce instantaneously to a value much lower than the 5-600 PSI and since the pressure in cavity 44 is trapped and can only be reduced gradually, an enormous pressure differential exists across inner case 22.

In accordance with this invention the spool/bolt arrangement generally illustrated by reference numeral 50 ties the inner case 22 to outer case 34 in such a manner as to enhance fatigue life and provide sufficient strength to withstand the compressor surge problems. Spool/bolt 50 comprises a spool member 52 having a reduced diameter threaded portion 54 at its lower extremity adapted to be threaded onto the complementary internal threads 56 formed in boss 58 extending radially from the outer surface 60 of inner case 22.

The bolt 62 comprises a relatively long shank 64 carrying threads 65 at the lower extremity and a significantly large head 66. Head 66 may be hexagonally shaped and is thicker and has a longer diameter than otherwise would be designed for this particular sized shank. These unusual dimensions of the head serve to reduce the stress concentration and increase fatigue life of the head to shank fillet adjacent the head.

The bolt 62 fits into bore 70 centrally formed in spool 52 that terminates just short of the remote end of the entrance to the bore. The inner diameter of bore 70 is threaded to accommodate the threaded portion of bolt 62. The spool 52 carries a tool receiving portion 72 for threadably securing the spool to inner case 22.

In the assembled condition, the spool 52 is threaded to inner case 22 and the bolt 62 passing through opening 74 in the outer case 34 is threaded to the inner threads of the spool 72, until the head bears against the outer surface of outer case 34 or a suitable washer. Tab washer 76 may be employed to prevent the bolt from inadvertently retracting.

After the spool is torqued sufficiently to urge flange portion 78 to bear against inner case 22, the bolt 62 is sufficiently torqued so that the flange-like portion 80 bears against the surface of outer case 34. The amount of torque will depend on the particular application but it should be sufficient to keep spool 52 in compression throughout the operating range of the engine.

As is apparent from the foregoing, the spool serves as a compressed flange-like member thus reducing both bolt fatigue and surge stresses. This configuration resists fatigue loads occasioned by thermal axial deflection differences between outer case 34 and the segmented inner case 22.

Also apparent from the foregoing and mentioned above is this arrangement resists the radial loads occasioned by a surge when there is an instantaneous and nearly complete loss in compressor flow path pressure.

The spool 52 also makes the threads 54 that mates with the inner case 22 to be insensitive to fatigue loading because it is preloaded by the spool washer face 84 that bears against the inner case.

The thread sizes of threads 65 of bolt 62 and threads 54 of spool 52 are different (the threads 54 are specifically designed to be larger). Because the diameter of the spool threads 54 are larger it has a higher disassembly breakaway torque than bolt 62. Consequently, the bolt will, by design, loosen first.

Although the invention has been shown and described with respect to detailed embodiments thereof, it will be understood by those skilled in the art that various changes in form and detail thereof may be made without departing from the spirit and scope of the claimed invention.

I claim:

1. For a gas turbine engine having a plurality of compressor stages, a first outer case being axially split rotatably supporting a first group of said compressor stages, a second outer case formed from a full hoop axially disposed to and attached to said first outer case, segmented stator members surrounding a second group of said compressor stages and defining an inner case, spool/bolt means having a spool element supported to said inner case and extending radially to bear against the inner surface of said first outer case, and having a bolt element extending radially through an opening in said outer case, said bolt element having a head portion bearing against the outer surface of said second outer case, said spool element having threads formed on the inner diameter thereof, said bolt element extending through an axial bore in said spool element and threadably engaging said spool element threads for tying said stator member to said second case.

2. For a gas turbine engine as claimed in claim 1 wherein said inner case has a radially extending boss formed on the outer diameter, threads formed in said boss, said spool element having a threaded portion formed on one end engaging said threads formed in said boss.

3. For a gas turbine engine as claimed in claim 2 wherein the threads on said spool element are large relative to the threads on said bolt.

4. For a gas turbine engine as claimed in claim 3 wherein said spool element has a planar annular surface formed adjacent to one end to define a washer face for bearing against the outer surface of said inner case.

5. For a gas turbine engine as claimed in claim 4 wherein said bolt includes a relatively large shank extending between the head of said bolt and said threads, and the threads on the inner diameter of said spool element are disposed adjacent said inner case.

6. For a gas turbine engine as claimed in claim 6 wherein said spool element includes a second planar surface formed on the end remote from the other planar surface to bear against the inner surface of said second outer case and said bolt element being sufficiently torqued when assembled that said spool element remains in compression throughout the operating envelope of said gas turbine engine.

* * * * *

UNITED STATES PATENT AND TRADEMARK OFFICE

CERTIFICATE OF CORRECTION

PATENT NO. : 5,297,932

DATED : Mar. 29, 1994

INVENTOR(S) : Thomas G. Johnson

It is certified that error appears in the above-identified patent and that said Letters Patent is hereby corrected as shown below:

ON column 1, line 3, insert —The invention was made under a U.S. Government contract and the Government has rights herein.—

Signed and Sealed this

Ninth Day of August, 1994

Bruce Lehman

*Attest:*

BRUCE LEHMAN

*Attesting Officer*

*Commissioner of Patents and Trademarks*